US006766841B2

(12) United States Patent
Cordonnier et al.

(10) Patent No.: US 6,766,841 B2
(45) Date of Patent: Jul. 27, 2004

(54) MULTI-LAYER STEEL CABLE FOR TIRE CROWN REINFORCEMENT

(75) Inventors: Francois-Jacques Cordonnier, Clermont-Ferrand (FR); Alain Domingo, Orleat (FR); Henri Barguet, Les Martres d'Artiere (FR)

(73) Assignee: Michelin Recherche et Technique, S.A., Granges-Paccot (CH)

( * ) Notice: Subject to any disclaimer, the term of this patent is extended or adjusted under 35 U.S.C. 154(b) by 0 days.

(21) Appl. No.: 10/613,238

(22) Filed: Jul. 3, 2003

(65) Prior Publication Data

US 2004/0060275 A1 Apr. 1, 2004

Related U.S. Application Data

(63) Continuation of application No. PCT/EP01/15189, filed on Dec. 21, 2001.

(30) Foreign Application Priority Data

Jan. 4, 2001 (FR) ..... 01 00281

(51) Int. Cl.[7] ..... B60C 9/00; B60C 9/20; D07B 1/08

(52) U.S. Cl. ..... 152/527; 57/213; 57/902; 152/451; 428/295.4

(58) Field of Search ..... 57/213, 902; 152/451, 152/527; 428/295.4

(56) References Cited

U.S. PATENT DOCUMENTS

| | | | |
|---|---|---|---|
| 4,781,016 | A | 11/1988 | Sato et al. |
| 5,561,974 | A | 10/1996 | Yamanaka et al. |
| 5,661,965 | A | 9/1997 | Yanagisawa |
| 5,697,204 | A | 12/1997 | Kuriya |
| 6,102,095 | A | 8/2000 | Obana et al. |
| 2002/0153078 | A1 | 10/2002 | Cordonnier et al. |

FOREIGN PATENT DOCUMENTS

| | | |
|---|---|---|
| EP | 0 675223 | 10/1995 |
| EP | 0719889 | 7/1996 |
| EP | 0 744490 | 11/1996 |
| WO | WO 98/41682 | 9/1998 |
| WO | WO 0100922 | 1/2001 |
| WO | WO 0149926 | 7/2001 |

OTHER PUBLICATIONS

RD 343070, Nov. 1992; pp. 857–859; Research Disclosure.
RD 34054; Aug. 1992; pp. 624–633, Research Disclosure.
RD 316107; Aug. 1990; p. 681; Research Disclosure.

*Primary Examiner*—Adrienne C. Johnstone
(74) *Attorney, Agent, or Firm*—Christopher P. Crecent; Martin Farrell; Alan A. Csontos

(57) ABSTRACT

A multi-layer cable having an unsaturated outer layer, usable as a reinforcing element for a crown reinforcement of a tire, comprising a core of diameter $d_0$ surrounded by an intermediate layer (C1) of four or five wires (N=4 or 5) of diameter $d_1$ wound together in a helix at a pitch $p_1$, this layer C1 itself being surrounded by an outer layer (C2) of P wires of diameter $d_2$ wound together in a helix at a pitch $p_2$, P being less by 1 to 3 than the maximum number $P_{max}$ of wires which can be wound in one layer about the layer C1, this cable having the following characteristics ($d_0$, $d_1$, $d_2$, $p_1$ and $p_2$ in mm):

(i) $0.10 \leqq d_0 < 0.50$;

(ii) $0.25 \leqq d_1 < 0.40$;

(iii) $0.25 \leqq d_2 < 0.40$;

(iv) for N=4: $0.40 < (d_0/d_1) < 0.80$;
for N=5: $0.70 < (d_0/d_1) < 1.10$;

(v) $4.8\ \pi(d_0+d_1) < p_1 < p_2 < 5.6\pi(d_0+2d_1+d_2)$; and (vi) the wires of layers C1 and C2 are wound in the same direction of twist.

The invention furthermore relates to the articles or semi-finished products made of plastics material and/or rubber which are reinforced by such a multi-layer cable, in particular to radial tires and their crown reinforcement plies.

50 Claims, 1 Drawing Sheet

MULTI-LAYER STEEL CABLE FOR TIRE CROWN REINFORCEMENT

CROSS REFERENCE TO RELATED APPLICATIONS

This application is a continuation of international application PCT/EPO1/15189, filed on 21 Dec. 2001, and published in the French language with an English abstract as WO 02/054827 A1 on Jul. 11, 2002.

BACKGROUND AND FIELD OF THE INVENTION

The present invention relates to steel cables ("steel cords") usable for reinforcing rubber articles such as tires. It relates more particularly to the cables referred to as "layered" cables usable for reinforcing the crown reinforcement of radial tires.

Steel cables for tires, as a general rule, are formed of wires of perlitic (or ferro-perlitic) carbon steel, hereinafter referred to as "carbon steel", the carbon content of which is generally between 0.2% and 1.2%, the diameter of these wires generally being between 0.10 and 0.50 mm (millimetres). A very high tensile strength is required of these wires, generally greater than 2000 MPa, preferably greater than 2500 MPa, which is obtained owing to the structural hardening which occurs during the phase of work-hardening of the wires. These wires are then assembled in the form of cables or strands, which requires the steels used also to have sufficient ductility in torsion to withstand the various cabling operations.

For reinforcing radial tires, most frequently so-called "layered" steel cables ("layered cords") or "multi-layer" steel cables formed of a central core and one or more concentric layers of wires arranged around this core are used. These layered cables are preferred to the older "stranded" cables ("strand cords") owing firstly to a lower industrial cost price, and secondly to greater compactness, which makes it possible in particular to reduce the thickness of the rubberised plies used for the manufacture of tires. Among layered cables, a distinction is made in particular, in known manner, between compact-structured cables and cables having tubular or cylindrical layers.

DISCUSSION OF RELATED ART

Such layered cables, usable in particular for reinforcing radial tires, have been described in a very large number of publications. Reference may be made in particular to the documents GB-A-2 080 845; U.S. Pat. Nos. 3,922,841; 4,158,946; 4,488,587; EP-A-0 168 858; EP-A-0 176 139 or U.S. Pat. No. 4,651,513; EP-A-0 194 011; EP-A-0 260 556 or U.S. Pat. Nos. 4,756,151; 4,781,016; EP-A-0 362 570; EP-A-0 497 612 or U.S. Pat. No. 5,285,836; EP-A-0 567 334 or U.S. Pat. No. 5,661,965; EP-A-0 568 271; EP-A-0 648 891; EP-A-0 661 402 or U.S. Pat. No. 5,561,974; EP-A-0 669 421 or U.S. Pat. No. 5,595,057; EP-A-0 675 223; EP-A-0 709 236 or U.S. Pat. No. 5,836,145; EP-A-0 719 889 or U.S. Pat. No. 5,697,204; EP-A-0 744 490 or U.S. Pat. No. 5,806,296; EP-A-0 779 390 or U.S. Pat. No. 5,802,829; EP-A-0 834 613 or U.S. Pat. No. 6,102,095; WO98/41682; RD (Research Disclosure) No. 316107, August 1990, pp. 681; RD No. 34054, August 1992, pp. 624–33; RD No. 34370, November 1992, pp. 857–59; RD No. 34779, March 1993, pp. 213–214; RD No. 34984, May 1993, pp. 333–344; RD No. 36329, July 1994, pp. 359–365.

Among these layered cables, the most widely found in crown reinforcements for radial tires are essentially cables of formula [M+N] or [M+N+P], the latter generally being intended for the largest tires. These cables are formed in known manner of a core of M wire(s) surrounded by at least one layer of N wires which may in turn be surrounded by an outer layer of P wires, with generally M varying from 1 to 4, N varying from 3 to 12, P varying from 8 to 20 if applicable, the whole possibly being wrapped by an external wrapping wire wound in a helix around the last layer.

In order to fulfil their function of reinforcing crown reinforcements for radial tires, the layered cables must first of all have a high compressive strength, which involves in particular their wires, at the very least for the majority thereof, having a relatively large diameter, generally at least equal to 0.25 mm, higher in particular than that of the wires used in conventional cables for carcass reinforcements for tires.

It is important on the other hand for these cables to be impregnated as much as possible by the rubber, and for this material to penetrate into all the spaces between the wires constituting the cables, because if this penetration is insufficient, there then form empty channels along the cables, and the corrosive agents, for example water, which are likely to penetrate into the tires for example as a result of cuts or other attack on the crown of the tire, move along these channels across the crown reinforcement of the tire. The presence of this moisture plays an important part in causing corrosion and in accelerating the fatigue processes (so-called "fatigue-corrosion" phenomena), compared with use in a dry atmosphere.

Thus, in order to improve the endurance of the layered cables in the reinforcement armatures of the tires, it has for a long time been proposed to modify their construction in order to increase in particular their ability to be penetrated by rubber, and thus to limit the risks due to corrosion and to fatigue-corrosion.

There have for example been proposed or described layered cables of the construction [3+9] or [3+9+15] which are formed of a core of 3 wires surrounded by a first layer of 9 wires and if applicable a second layer of 15 wires, as described, for example, in EP-A-0 168 858, EP-A-0 176 139, EP-A-0 497 612, EP-A-0 568 271, EP-A-0 669 421, EP-A-0 709 236, EP-A-0 744 490, EP-A-0 779 390, EP-A-0 834 613, RD No. 34984, May 1993, pp. 333–344, the diameter of the wires of the core being or not being greater than that of the wires of the other layers. It is know that these cables cannot be penetrated by rubber. A channel or capillary remains at the center of the three core wires, which remains empty after impregnation by the rubber, and therefore favourable to the propagation of corrosive media such as water.

The publication RD No. 34370, in order to solve this problem, proposes cables of structure [1+6+12], of the compact type or of the type having concentric tubular layers, formed of a core formed of a single wire, surrounded by an intermediate layer of 6 wires which itself is surrounded by an outer layer of 12 wires. The ability to be penetrated by rubber can be improved by using diameters of wires which differ from one layer to the other, or even within one and the same layer. Cables of construction [1+6+12], the penetration ability of which is improved owing to appropriate selection of the diameters of the wires, in particular to the use of a core wire of larger diameter, have also been described, for example in EP-A-0 648 891 or WO98/41682.

In order to improve the penetration of the rubber into the cables, there have also been proposed or described multi-layer cables having a central core surrounded by at least two concentric layers, in particular cables of the formula [1+N+P] (for example [1+4+P] or [1+5+P]) or even [2+N+P] (for example [2+5+P]), the outer layer of which is unsaturated (i.e. incomplete), thus ensuring better ability to be penetrated by rubber (see, for example, RD No. 316107, August 1990, p. 681; EP-A-0 567 334 or U.S. Pat. No. 5,661,965; EP-A-0 661 402 or U.S. Pat. No. 5,561,974; EP-A-0 675 223).

Experience shows, however, that these cables having improved penetration ability have not, for the most part, yet been penetrated to the centre by the rubber, and in any case do not provide optimum performance in a tire.

It should in fact be noted that an improvement in the ability to be penetrated by rubber is not sufficient to ensure an optimum level of performance. When they are used for reinforcing crown reinforcements of tires, the cables must not only resist corrosion, but also must fulfil a large number of other, sometimes contradictory, criteria, in particular of tenacity, high degree of adhesion to rubber, uniformity, flexibility, resistance to impact and perforation, endurance under compression and under flexion-compression, all in a more or less corrosive atmosphere.

Thus, for all the reasons set forth previously, and despite the various recent improvements which have been made here or there on such and such a given criterion, the best cables used today in crown reinforcements for radial tires, intended in particular for heavy vehicles, remain limited to a small number of layered cables of highly conventional structure, of the compact type or the type having cylindrical layers, with a saturated (i.e. complete) outer layer; these are essentially cables of constructions [3+9] and particularly [3+9+15] as described previously.

BRIEF DESCRIPTION OF THE INVENTION

The applicants during their research discovered a novel layered cable, of the type [M+N+P] having an unsaturated outer layer (with N equal to 4 or 5), which, owing to a specific structure, has not only excellent ability to be penetrated by rubber, limiting the problems of corrosion, but also increased endurance under compression. The longevity of the tires and that of their crown reinforcements is thus improved.

Consequently, a first subject of the invention is a multilayer cable having a unsaturated outer layer, which can be used as a reinforcement element for a crown reinforcement of a tire, comprising a core (C0) of diameter $d_0$ surrounded by an intermediate layer (C1) of four or five wires (N=4 or 5) of diameter $d_1$ wound together in a helix at a pitch $p_1$, this layer C1 itself being surrounded by an outer layer (C2) of P wires of diameter $d_2$ wound together in a helix at a pitch $p_2$, P being less by 1 to 3 than the maximum number $P_{max}$ of wires which can be wound in one layer about the layer C1, this cable being characterised in that it has the following characteristics ($d_0$, $d_1$, $d_2$, $p_1$ and $p_2$ in mm):

(i) $0.10 \leqq d_0 < 0.50$;

(ii) $0.25 \leqq d_1 < 0.40$;

(iii) $0.25 \leqq d_2 < 0.40$;

(iv) for N=4: $0.40 < (d_0/d_1) < 0.80$;

for N=5: $0.70 < (d_0/d_1) < 1.10$;

(v) $4.8\pi(d_0+d_1) < p_1 < p_2 < 5.6\pi(d_0+2d_1+d_2)$;

(vi) the wires of layers C1 and C2 are wound in the same direction of twist.

The invention also relates to the use of a cable according to the invention for reinforcing articles or semi-finished products made of plastics material and/or of rubber, for example plies, tubes, belts, conveyor belts and tires, more particularly radial tires which use a metal crown reinforcement.

The cable of the invention is very particularly intended to be used as a reinforcing element for the crown reinforcements of radial tires intended for industrial vehicles selected from among vans, "heavy vehicles"—i.e. subway trains, buses, road transport machinery (lorries, tractors, trailers), off-road vehicles—agricultural machinery or construction machinery, aircraft, and other transport or handling vehicles.

The invention furthermore relates to these articles or semi-finished products made of plastics material and/or rubber themselves when they are reinforced by a cable according to the invention, in particular tires intended for the vehicles mentioned above, and also to composite fabrics comprising a matrix of rubber composition reinforced with a cable according to the invention, usable in particular as a crown reinforcement ply for such tires.

BRIEF DESCRIPTION OF THE DRAWINGS

The invention and its advantages will be readily understood in the light of the description and examples of embodiment which follow, and FIGS. 1 and 2 relating to these examples, which show, respectively:

a cross-section through a cable of structure [1+5+10] according to the invention (FIG. 1);

Figure 2:
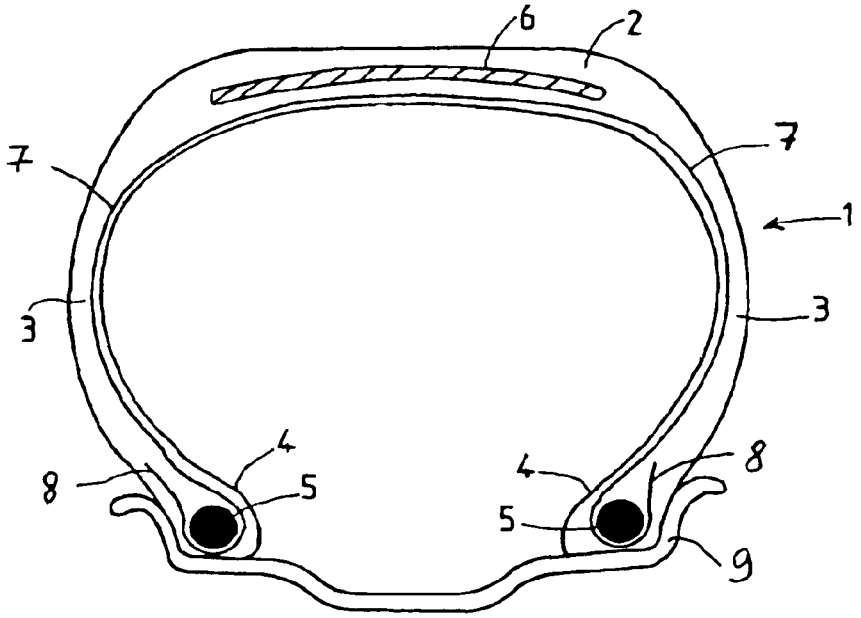

a radial section through a radial tire having a metallic crown reinforcement (FIG. 2).

DETAILED DESCRIPTION OF THE INVENTION

Measurements and Tests

I-1. Dynamometric Measurements

As far as the metal wires or cables are concerned, the measurements of breaking load Fm (maximum load in N), of tensile strength Rm (in MPa) and of elongation at break At (total elongation in %) are carried out under tension in accordance with ISO Standard 6892 of 1984. As far as the rubber compositions are concerned, the measurements of modulus are carried out under tension in accordance with French Standard NF T 46-002 of September 1988: the nominal secant modulus (or tensile stress) is measured in a second elongation (i.e. after an accommodation cycle) at 10% elongation, referred to as MA10, expressed in MPa, under normal conditions of temperature (23±2° C.) and humidity (50±5 relative humidity) (Standard NF T 40-101 of December 1979).

I-2. Air Permeability Test

The air permeability test makes it possible to measure a relative index of air permeability, "Pa". It is a simple way of indirectly measuring the degree of penetration of the cable by a rubber composition. It is performed on cables extracted directly, by decortication, from the vulcanised rubber plies which they reinforce, and which therefore have been penetrated by the cured rubber.

The test is carried out on a given length of cable (for example 2 cm) as follows: air is sent to the entry of the cable, at a given pressure (for example 1 bar), and the quantity of air is measured at the exit, using a flow meter; during the measurement, the sample of cable is locked in a seal such that only the quantity of air passing through the cable from one end to the other, along its longitudinal axis, is taken into account by the measurement. The flow rate measured is lower, the higher the amount of penetration of the cable by the rubber.

DETAILED DESCRIPTION OF THE INVENTION

II-1. Cable of the Invention

The terms "formula" or "structure", when used in the present description to describe the cables, refer simply to the construction of these cables.

The cable of the invention is a multi-layer cable comprising a core (C0) of diameter $d_0$, an intermediate layer (C1) of 4 or 5 wires (N=4 or 5) of diameter $d_1$ and an unsaturated outer layer (C2) of P wires of diameter $d_2$, P being less by 1 to 3 than the maximum number $P_{max}$ of wires which can be wound in a single layer around the layer C1.

In this layered cable of the invention, the diameter of the core and that of the wires of the layers C1 and C2, the helix pitches (and hence the angles) and the directions of winding of the different layers are defined by all the characteristics cited hereafter ($d_0$, $d_1$, $d_2$, $p_1$ and $p_2$ expressed in mm):

(i) $0.10 \leqq d_0 < 0.50$;

(ii) $0.25 \leqq d_1 < 0.40$;

(iii) $0.25 \leqq d_2 < 0.40$;

(iv) for N=4: $0.40 < (d_0/d_1) < 0.80$;

for N=5: $0.70 < (d_0/d_1) < 1.10$;

(v) $4.8\pi(d_0+d_1) < p_1 < p_2 < 5.6\pi(d_0+2d_1+d_2)$;

(vi) the wires of layers C1 and C2 are wound in the same direction of twist.

Characteristics (i) to (vi) above, in combination, make it possible to obtain, all at once: due to optimisation of the ratio of the diameters ($d_0/d_1$) and the helix angles formed by the wires of layers C1 and C2, optimum penetration of the rubber through layers C1 and C2 and as far as the centre C0 of the latter, which ensures very high protection against corrosion and the possible propagation thereof;

minimal disorganisation of the cable under high flexural stress, not requiring in particular the presence of a wrapping wire around the final layer;

high endurance under flexion and flexion-compression.

In order to reinforce still further the technical effects above, the cable of the invention, in particular when it is devoid of an external wrapping wire, preferably satisfies the characteristic (vii) hereafter:

a) $5.0\pi(d_0+d_1) < p_1 < p_2 < 5.0\pi(d_0+2d_1+d_2)$.

Characteristics (v) and (vi)—different pitches $p_1$ and $p_2$, and layers C1 and C2 wound in the same direction of twist—mean that, in known manner, the wires of layers C1 and C2 are essentially arranged in two adjacent, concentric cylindrical (i.e. tubular) layers. So-called "tubular" or "cylindrical" layered cables are thus understood to be cables formed of a core (i.e. core part or central part) and of one or more concentric layers, each tubular in shape, arranged around this core, such that, at least in the cable at rest, the thickness of each layer is substantially equal to the diameter of the wires which form it; as a result, the cross-section of the cable has a contour or shell (E) which is substantially circular, as illustrated for example in FIG. 1.

The cables having cylindrical or tubular layers of the invention must in particular not be confused with so-called "compact" layered cables, which are assemblies of wires wound with the same pitch and in the same direction of twist; in such cables, the compactness is such that practically no distinct layer of wires is visible; as a result, the cross-section of such cables has a contour which is no longer circular, but polygonal.

The outer layer C2 is a tubular layer of P wires which is referred to as "unsaturated" or "incomplete", that is to say that, by definition, there is sufficient space in this tubular layer C2 to add at least one (P+1)th wire of diameter $d_2$, several of the P wires possibly being in contact with one another. Reciprocally, this tubular layer C2 would be referred to as "saturated" or "complete" if there was not enough space in this layer to add at least one (P+1)th wire of diameter $d_2$.

Figure 1:
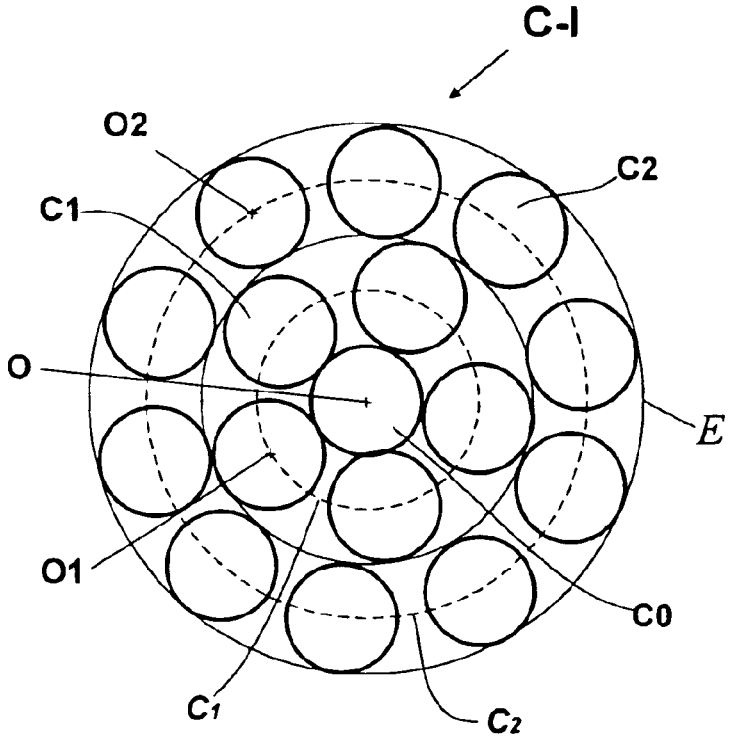

Preferably, the cable of the invention is a layered cable of construction [1+N+P], that is to say that its core is formed of a single wire (M=1), as shown, for example, in FIG. 1 (cable referenced C-1).

This FIG. 1 shows a section perpendicular to the axis (O) of the core and of the cable, the cable being assumed to be rectilinear and at rest. It can be seen that the core C0 (diameter $d_0$) is formed of a single wire; it is surrounded by and in contact with an intermediate layer C1 of 5 wires of diameter $d_1$ which are wound together in a helix at a pitch $p_1$; this layer C1, which is of a thickness substantially equal to $d_1$, is itself surrounded by and in contact with an outer layer C2 of 10 wires of diameter $d_2$ which are wound together in a helix at a pitch $p_2$, and therefore of a thickness substantially equal to $d_2$. The wires wound around the core C0 are thus arranged in two adjacent, concentric, tubular layers (layer C1 of thickness substantially equal to $d_1$, then layer C2 of thickness substantially equal to $d_2$). It can be seen that the wires of layer $C_1$ have their axes ($O_1$) arranged practically on a first circle C1 shown by broken lines, whereas the wires of layer C2 have their axes ($O_2$) arranged practically on a second circle $C_2$, also shown by broken lines.

The diameter $d_0$ of the core preferably lies within a range of from 0.15 to 0.30 mm, more particularly of 0.15 to 0.20 mm in the case of a cable of structure [M+4+P], of 0.20 to 0.30 mm in the case of a cable of structure [M+5+P], with in particular M equal to 1.

The best compromise of results, with regard in particular to the ability of the cable to be penetrated by the rubber, measured in what is called the air permeability test, and the properties of endurance under compression, is obtained when the following relationship is satisfied:

a) $5.3\pi(d_0+d_1) < p_1 < p_2 < 4.7\pi(d_0+2d_1+d_2)$.

By thus offsetting the pitches and therefore the angles of contact between the wires of layer C1 on one hand and those of layer C2 on the other hand, the surface area of the channels for penetrating between these two layers is increased and the ability of the cable to be penetrated is improved further, while optimising its fatigue-corrosion and compression performance.

It will be recalled here that, according to a known definition, the pitch represents the length, measured parallel to the axis O of the cable, at the end of which a wire having this pitch makes a complete turn around the axis O of the cable; thus, if the axis O is sectioned by two planes perpendicular to the axis O and separated by a length equal to the pitch of a wire of one of the two layers C1 or C2, the axis of this wire ($O_1$ or $O_2$) has in these two planes the same position on the two circles corresponding to the layer C1 or C2 of the wire in question.

In the cable according to the invention, all the wires of the layers C1 and C2 are wound in the same direction of twist, that is to say in the S direction ("S/S" arrangement) or in the Z direction ("Z/Z" arrangement"). Such an arrangement of the layers C1 and C2 is somewhat contrary to the most conventional constructions of layered cables [M+N+P], in particular those of construction [3+9+15], which most frequently require crossing of the two layers C1 and C2 (or an "S/Z" or "Z/S" arrangement) so that the wires of layer C2 themselves wrap the wires of layer C1.

Winding the layers C1 and C2 in the same direction advantageously makes it possible, in the cable according to the invention, to minimise the friction between these two layers C1 and C2 and therefore the wear of the wires constituting them.

In the cable of the invention, the ratios ($d_0/d_1$) must be set within given limits, according to the number N (4 or 5) of wires of the layer C1. Too low a value of this ratio is unfavourable to the ability to be penetrated by rubber. Too high a value adversely affects the compactness of the cable, for a level of resistance which is finally not greatly modified; the increased rigidity of the core due to an excessively large diameter $d_0$ would furthermore be unfavourable to the feasibility itself of the cable during the cabling operations.

The wires of layers C1 and C2 may have a diameter which is identical or different from one layer to the other. Preferably wires of the same diameter ($d_1=d_2$) are used, in particular to simplify the cabling process and to reduce the costs, as shown, for example, in FIG. 1.

The maximum number $P_{max}$ of wires which can be wound in a single saturated layer around the layer C1 is of course a function of numerous parameters (diameter $d_0$ of the core, number N and diameter $d_1$ of the wires of layer C1, diameter $d_2$ of the wires of layer C2). By way of example, if $P_{max}$ is equal to 12, P may then vary from 9 to 11 (for example constructions [1+N+9], [1+N+10] or [1+N+11]); if $P_{max}$ is for example equal to 11, P may then vary from 8 to 10 (for example constructions [1+N+8], [1+N+9] or [1+N+10]).

Preferably, the number P of wires in the layer C2 is less by 1 to 2 than the maximum number $P_{max}$. This makes it possible, in the majority of cases, to form sufficient space between the wires for the rubber compositions to be able to infiltrate between the wires of layer C2 and to reach layer C1. The invention is thus preferably implemented with a cable selected from among cables of the structure [1+4+8], [1+4+9], [1+4+10], [1+5+9], [1+5+10] and [1+5+11].

By way of examples of preferred cables according to the invention, mention will be made in particular of cables which have the following constructions (and, among those, those which more preferably satisfy at least one of the aforementioned relationships (vii) and (viii)):

i)—[1+4+8] with $d_0$=0.20 mm and $d_1=d_2$=0.35 mm; 8.3 mm<$p_1$<$p_2$<21.0 mm;

ii)—[1+4+8] with $d_0$=0.20 mm and $d_1=d_2$=0.38 mm; 8.7 mm<$p_1$<$p_2$<23.6 mm;

iii)—[1+4+9] with $d_0$=0.20 mm and $d_1=d_2$=0.26 mm; 6.9 mm<$p_1$<$p_2$<17.2 mm;

iv)—[1+4+9] with $d_0$=0.15 mm and $d_1=d_2$=0.30 mm; 6.8 mm<$p_1$<$p_2$<18.5 mm;

v)—[1+4+10] with $d_0$=0.20 mm and $d_1=d_2$=0.28 mm; 7.2 mm<$p_1$<$p_2$<18.3 mm;

vi)—[1+4+10] with $d_0$=0.15 mm and $d_1=d_2$=0.26 mm; 6.2 mm<$p_1$<$p_2$<16.4 mm;

vii)—[1+5+9] with $d_0$=0.20 mm and $d_1=d_2$=0.26 mm; 6.9 mm<$p_1$<$p_{<2}$17.2 mm;

viii)—[1+5+9] with $d_0=d_0$=0.26 mm; $d_2$=0.30 mm; 7.8 mm<$p_1$<$p_2$<19.0 mm;

ix)—[1+5+10] with $d_0=d_2$=0.26 mm and $d_1$=0.28 mm; 8.1 mm<$p_1$<$p_2$<19.10 mm;

x)—[1+5+10] with $d_0$=0.28 mm and $d_1=d_2$=0.30 mm; 8.7 mm<$p_1$<$p_2$<20.8 mm;

xi)—[1+5+11] with $d_0=d_1=d_2$=0.26 mm; 7.8 mm<$p_1$<$p_2$<18.3 mm.

xii)—[1+5+11] with $d_0$=0.28 mm and $d_1=d_2$=0.26 mm; 8.1 mm<$p_1$<$p_2$<18.6 mm.

It will be noted that, in these cables, at least two layers out of three (C0, C1, C2) contain wires of diameters (respectively $d_0$, $d_1$, $d_2$) which are identical.

The invention is preferably implemented, in the crown reinforcements of heavy-vehicle tires, with cables of structure [1+5+P], more preferably of structure [1+5+9], [1+5+10] or [1+5+11]. More preferably still, cables of structure [1+5+10] or [1+5+11] are used.

For such [1+5+P] cables, one advantageous embodiment of the invention consists in using wires of the same diameter for the core and at least one of the layers C1 and C2, or indeed for the two layers (in this case, $d_0=d_1=d_2$), as shown for example in FIG. 1.

However, in order further to increase the ability of the cable to be penetrated by rubber, the wires of layer C1 may be selected to be of greater diameter than those of layer C2, for example in a ratio ($d_1/d_2$) which is preferably between 1.05 and 1.30.

For a better compromise between strength, feasibility, rigidity and compressive strength of the cable on one hand and ability to be penetrated by the rubber compositions on the other hand, it is preferred that the diameters of the wires of layers C1 and C2, whether or not these wires are of identical diameters, lie within a range from 0.25 to 0.35 mm.

In such a case, in particular when $d_1=d_2$, the pitches $p_1$ and $p_2$ are preferably selected between 7 and 21 mm, while more preferably satisfying at least one of the aforementioned relationships (vii) or (viii). One advantageous embodiment consists, for example, of selecting $p_1$ to be between 7 and 14 mm and $p_2$ to be between 14 and 21 mm.

The invention may be implemented with any type of steel wires, for example carbon steel wires and/or stainless steel wires as described, for example, in the above applications EP-A-0 648 891 or WO98/41682. Preferably a carbon steel is used, but it is of course possible to use other steels or other alloys.

When a carbon steel is used, its carbon content (% by weight of steel) is preferably between 0.50% and 1.0%, more preferably between 0.68% and 0.95%; these contents represent a good compromise between the mechanical properties required for the tire and the feasibility of the wire. It should be noted that, in applications in which the highest mechanical strengths are not necessary, advantageously carbon steels may be used, the carbon content of which is between 0.50% and 0.68%, and in particular varies from 0.55% to 0.60%, such steels ultimately being less costly because they are easier to draw. Another advantageous embodiment of the invention may also consist, depending on the intended applications, of using steels having a low carbon content of for example between 0.2% and 0.5%, owing in particular to lower costs and greater ease of drawing.

The wires constituting the cables of the invention preferably have a tensile strength greater than 2000 MPa, more preferably greater than 3000 MPa. In the case of tires of very large dimensions, in particular wires having a tensile strength of between 3000 MPa and 4000 MPa will be selected. The person skilled in the art will know how to manufacture carbon steel wires having such strength, by adjusting in particular the carbon content of the steel and the final work-hardening ratios ($\epsilon$) of these wires.

The cable of the invention might comprise an external wrap, formed for example of a single wire, whether or not of metal, wound in a helix about the cable in a pitch shorter than that of the outer layer, and a direction of winding opposite or identical to that of this outer layer.

However, owing to its specific structure, the cable of the invention, which is already self-wrapped, does not generally require the use of an external wrapping wire, which firstly advantageously solves the problems of wear between the wrap and the wires of the outermost layer of the cable, and secondly makes it possible to reduce the diameter of bulk and the cost of the cable.

However, if a wrapping wire is used, in the general case in which the wires of layer C2 are made of carbon steel, advantageously a wrapping wire of stainless steel may then be selected in order to reduce the wear by fretting of these carbon steel wires in contact with the stainless steel wrap, as taught by Application WO98/41682 referred to above, the stainless steel wire possibly being replaced in equivalent manner by a composite wire, only the skin of which is of stainless steel and the core of which is of carbon steel, as described for example in Patent Application EP-A-0 976 541.

II-2. Tire of the invention

The cable of the invention is advantageously usable in crown reinforcements for all types of tires, in particular for tires for large vans, heavy vehicles or construction vehicles.

By way of example, FIG. 2 shows diagrammatically a radial section through a tire having a metallic crown reinforcement which may or may not be in accordance with the invention, in this general representation. This tire 1 comprises a crown 2 reinforced by a crown reinforcement 6, two sidewalls 3 and two beads 4, each of these beads 4 being reinforced by a bead wire 5. The crown 2 is surmounted by a tread not shown in this diagrammatic figure. A carcass reinforcement 7 is wound around the two bead wires 5 within each bead 4, the upturn 8 of this reinforcement 7 being for example arranged towards the outside of the tire 1, which is shown here mounted on its rim 9. The carcass reinforcement 7 in a manner known per se is formed of at least one ply reinforced by what are called "radial" cables, that is to say that these cables are arranged practically parallel to each other and extend from one bead to the other so as to form an angle of between 80° and 90° with the median circumferential plane (plane perpendicular to the axis of rotation of the tire which is located half-way between the two beads 4 and passes through the centre of the crown reinforcement 6).

The tire according to the invention is characterised in that its crown reinforcement 6 comprises at least one crown ply, the reinforcement cables of which are multi-layer steel cables according to the invention. In this crown reinforcement 6 which is illustrated very simply in FIG. 2, it will be understood that the cables of the invention may for example reinforce all or part of what are called the working crown plies, or of what are called the triangulation crown plies (or half-plies) and/or of what are called the protective crown plies, when such triangulation or protective crown plies are used. In addition to the working plies, the triangulation and/or protective plies, the crown reinforcement 6 of the tire of the invention may of course comprise other crown plies, for example one or more what are called wrapping crown plies.

In this crown reinforcement ply, the density of the cables according to the invention is preferably between 20 and 70 cables per dm (decimetre) of crown ply, more preferably between 30 and 60 cables per dm of ply, the distance between two adjacent cables, from axis to axis, thus being preferably between 1.4 and 5.0 mm, more preferably between 1.7 and 3.3 mm. The cables according to the invention are preferably arranged such that the width ("l") of the rubber bridge, between two adjacent cables, is between 0.5 and 2.0 mm. This width l in known manner represents the difference between the calendering pitch (laying pitch of the cable in the rubber fabric) and the diameter of the cable. Below the minimum value indicated, the rubber bridge, which is too narrow, risks mechanically degrading during working of the ply, in particular during the deformation which it experiences in its own plane by extension or shearing. Beyond the maximum indicated, there are risks of the appearance of penetration of objects, by perforation, between the cables. More preferably, for these same reasons, the width l is selected to be between 0.8 and 1.6 mm.

Preferably, the rubber composition used for the fabric of the crown reinforcement ply has, when vulcanised, (i.e. after curing) a secant tensile modulus MA10 which is greater than 5 MPa. More preferably, the modulus MA10 lies between 5 and 20 MPa, in particular between 5 and 10 MPa when this fabric is intended to form a triangulation ply or protective ply for the crown reinforcement, between 8 and 20 MPa when this fabric is intended to form a working ply of the crown reinforcement. It is within such ranges of moduli that the best compromise of endurance was recorded between the cables of the invention on one hand and the fabrics reinforced with these cables on the other hand.

EXAMPLES OF EMBODIMENT OF THE INVENTION

III-1. Nature and Properties of the Wires Used

To produce the examples of cables whether or not in accordance with the invention, fine carbon steel wires are used which are prepared in accordance with known methods such as are described, for example, in applications EP-A-0 648 891 or WO98/41682 mentioned above, starting from commercial wires, the initial diameter of which is approximately 1.75 mm. The steel used is a known carbon steel, the carbon content of which is about 0.9%.

The commercial starting wires first undergo a known degreasing and/or pickling treatment before their later working. At this stage, their tensile strength is equal to about 1150 MPa, and their elongation at break is approximately 10%. Then copper is deposited on each wire, followed by a deposit of zinc, electrolytically at ambient temperature, and then the wire is heated thermally by Joule effect to 540° C. to obtain brass by diffusion of the copper and zinc, the weight ratio (phase $\alpha$)/(phase $\alpha$+phase $\beta$) being equal to approximately 0.85. No heat treatment is performed on the wire once the brass coating has been obtained.

Then so-called "final" work-hardening is effected on each wire (i.e. after the final heat treatment), by cold-drawing in a wet medium with a drawing lubricant which is in the form of an emulsion in water. This wet drawing is effected in known manner in order to obtain the final work-hardening ratio ($\epsilon$), calculated from the initial diameter indicated above for the commercial starting wires.

By definition, the ratio of a work-hardening operation, $\epsilon$, is given by the formula $\epsilon = \mathrm{Ln}\,(S_i/S_f)$, in which Ln is the Naperian logarithm, $S_i$ represents the initial section of the wire before this work-hardening and $S_f$ the final section of the wire after this work-hardening.

By adjusting the final work-hardening ratio, thus two groups of wires of different diameters are prepared, a first group of wires of average diameter $\phi$ equal to approximately 0.26 mm ($\epsilon$=3.8) for the wires of index 1 (wires marked F1) and a second group of wires of average diameter $\phi$ equal to approximately 0.28 mm ($\epsilon$=3.7) for the wires of index 2 (wires marked F2).

The steel wires thus drawn have the mechanical properties indicated in Table 1.

TABLE 1

| Wires | ϕ (mm) | Fm (N) | At (%) | Rm (MPa) |
|---|---|---|---|---|
| F1 | 0.260 | 188 | 2.0 | 3550 |
| F2 | 0.280 | 194 | 2.0 | 3150 |

The elongation At shown for the wires is the total elongation recorded at break of the wire, that is to say integrating both the elastic portion of the elongation (Hooke's Law) and the plastic portion of the elongation.

The brass coating which surrounds the wires is of very low thickness, significantly less than one micrometre, for example of the order of 0.15 to 0.30 $\mu$m, which is negligible compared with the diameter of the steel wires. Of course, the composition of the steel of the wire in its different elements (for example C, Mn, Si) is the same as that of the steel of the starting wire.

It will be recalled that during the process of manufacturing the wires, the brass coating facilitates the drawing of the wire, as well as the sticking of the wire to the rubber. Of course, the wires could be covered with a fine metal layer other than brass, having for example the function of improving the corrosion resistance of these wires and/or the adhesion thereof to the rubber, for example a fine layer of Co, Ni, Zn, Al, or of an alloy of two or more of the compounds Cu, Zn, Al, Ni, Co, Sn.

III-2. Production of the Cables

The above wires are then assembled in the form of layered cables of structure [1+5+10]. These cables are manufactured using cabling devices (BARMAG cabler) and using processes well-known to the person skilled in the art which are not described here in order to simplify the description. Owing to the different pitches $p_1$ and $p_2$, they are produced in two successive operations (manufacture of a [1+5] cable then cabling of the final layer around this [1+5] cable), these two operations possibly advantageously being effected in-line using two cablers arranged in series.

These cables according to the invention have the following characteristics:

structure [1+5+10]

$d_0=d_2=0.26$;

$d_1=0.28$;

$(d_0/d_1)=0.93$;

$(d_1/d_2)=1.08$;

$p_1=10$ (S); $p_2=15$ (S).

The wires $F_2$ of layers C1 and C2 are wound in the same direction of twist (S direction). The cable tested is devoid of wrap and has a diameter of approximately 1.34 mm. The core of this cable has a diameter $d_0$ which is equal to that of its single wire, which is practically devoid of torsion on itself.

The cable of the invention shown as an example here is a cable having tubular layers as shown in cross-section in FIG. 1, which has already been commented on. It is distinguished from the cables of the prior art in particular by the fact that its outer layer C2 comprises two wires less than a conventional saturated cable, and that its pitches $p_1$ and $p_2$ are different, while furthermore satisfying the relationship (v) above. In other words, in this cable, P is less by 2 than the maximum number (here $P_{max}=12$) of wires which can be wound in a single saturated layer around the layer C1. In order further to increase its ability to be penetrated by rubber, the wires of layer C1 have been selected to be of greater diameter than those of layer C2, in a preferred ratio $(d_1/d_2)$ which is between 1.05 and 1.15.

It will be noted that this cable of the invention (N=5) does satisfy the following characteristics:

(i) $0.10 \leqq d_0 < 0.50$;

(ii) $0.25 \leqq d_1 < 0.40$;

(iii) $0.25 \leqq d_2 < 0.40$;

(iv) $0.70 \leqq (d_0/d_1) < 1.10$;

(v) $4.8\pi(d_0+d_1) < p_1 < p_2 < 5.6\pi(d_0+2d_1+d_2)$;

(vi) the wires of layers C1 and C2 are wound in the same direction of twist.

This cable C-I exhibited an excellent ability to be penetrated by rubber, measured in the air permeability test. It furthermore satisfies each of the following preferred relationships:

$0.20 \leqq d_0 < 0.30$;

$0.25 \leqq d_1 < 0.35$;

$0.25 \leqq d_2 < 0.35$;

$5.0\pi(d_0+d_1) < p_1 < p_2 < 5.0\ \pi(d_0+2d_1+d_2)$.

The mechanical properties of this cable are set forth in Table 2 below.

TABLE 2

| Fm (N) | At (%) | Rm (MPa) |
|---|---|---|
| 2827 | 3.1 | 3107 |

The elongation At shown for the cable is the total elongation recorded at break of the cable, that is to say integrating all of the following: the elastic portion of the elongation (Hooke's Law), the plastic portion of the elongation and the so-called structural portion of the elongation, which is inherent to the specific geometry of the cable tested.

III-3. Production of the Tires

For manufacturing the tires of the invention, the procedure is as follows. The above layered cables are incorporated by calendering on a rubberised fabric formed of a known composition based on natural rubber and carbon black as reinforcing filler, which is conventionally used for manufacturing crown reinforcement plies for radial tires (modulus MA10 equal to approximately 18 MPa, after curing). This composition essentially comprises, in addition to the elastomer and the reinforcing filler, an antioxidant, stearic acid, a reinforcing resin (phenolic resin plus methylene donor), cobalt naphthenate as adhesion promoter, and finally a vulcanisation system (sulphur, accelerator, ZnO). In the rubber fabric, the cables are arranged parallel in known manner, at a given cable density, for example 40 cables per dm of ply, which, taking into account the diameter of the cables, is equivalent to a width "l" of the rubber bridges, between two adjacent cables, lying within a particularly preferred range from 1.0 to 1.4 mm (in the present case, about 1.16 mm).

The tires, manufactured in known manner, are such as shown diagrammatically in FIG. 2, which has already been commented on. Their radial carcass reinforcement 7 is, for example, formed of a single radial ply formed of a conventional rubberised fabric comprising conventional metal cables arranged at an angle of about 90° with the median circumferential plane.

As for the crown reinforcement 6, it is formed of (i) two crossed superposed working plies, reinforced with metal cables inclined by 22 degrees, these two working plies being covered by (ii) a protective crown ply reinforced by conventional elastic metal cables inclined at 22 degrees. Each of the two working plies is formed of the rubberised fabric according to the invention.

In summary, the cables of the invention make it possible to reduce the phenomena of corrosion and of fatigue-corrosion, in particular under conditions of compressive fatigue, in particular in crown reinforcements for radial tires, and thus to improve the longevity of such crown reinforcements.

Their specific construction makes it possible, during the moulding and/or curing of the tires, for virtually complete migration of the rubber into the cable to occur, as far as the centre of the latter, without forming empty channels. The cable, which is thus rendered impermeable by the rubber, is protected from the flows of oxygen and moisture which pass, for example, from the tread of the tires towards the zones of the crown reinforcement, where the cable, in known manner, is subjected to the most frequent external attacks.

Of course, the invention is not limited to the examples of embodiment described above.

Thus, for example, the core C0 of the cables of the invention might be formed of a wire of non-circular section, for example, one which is plastically deformed, in particular a wire of substantially oval or polygonal section, for example triangular, square or alternatively rectangular; the core C0 might also consist of a preformed wire, whether or not of circular section, for example an undulating or cork-screwed wire, or one twisted into the shape of a helix or a zigzag. In such cases, it should of course be understood that the diameter $d_0$ of the core represents the diameter of the imaginary cylinder of revolution which surrounds the core wire (diameter of bulk), and not the diameter (or any other transverse size, if its section is not circular) of the core wire itself. The same would apply if the core C0 were formed not of a single wire as in the above examples, but of several wires assembled together, for example of two wires arranged parallel to each other or alternatively twisted together, in a direction of twist which may or may not be identical to that of the intermediate layer C1.

For reasons of industrial feasibility, cost and overall performance, it is however preferred to implement the invention with a single conventional linear core wire, of circular section.

Furthermore, since the core wire is less stressed during the cabling operation than the other wires, bearing in mind its position in the cable, it is not necessary for this wire to use, for example, steel compositions which offer high ductility in torsion; advantageously, any type of steel could be used, for example a stainless steel, in order to result, for example, in a hybrid steel cable such as described in the aforementioned application WO98/41682, comprising a stainless steel wire at the centre and carbon steel wires around it.

Furthermore, (at least) one linear wire of one of the two layers C1 and/or C2 might also be replaced by a preformed or deformed wire, or more generally by a wire of section different from that of the other wires of diameter $d_1$ and/or $d_2$, so as, for example, to improve still further the ability of the cable to be penetrated by rubber or any other material, the diameter of bulk of this replacement wire possibly being less than, equal to or greater than the diameter ($d_1$ and/or $d_2$) of the other wires constituting the layer (C1 and/or C2) in question.

Without modifying the spirit of the invention, all or part of the wires constituting the cable according to the invention might be constituted of wires other than steel wires, whether metallic or not, in particular wires of inorganic or organic material having a high mechanical strength, for example monofilaments of liquid-crystal organic polymers such as described in Application WO92/12018.

The invention also relates to any multi-strand steel cable ("multi-strand rope"), the structure of which incorporates, at least, as the elementary strand, a layered cable according to the invention.

We claim:

1. A multi-layer cable having a unsaturated outer layer, usable as a reinforcing element for a tire crown reinforcement, comprising a core (C0) of diameter $d_0$ surrounded by an intermediate layer (C1) of four or five wires (N=4 or 5) of diameter $d_1$ wound together in a helix at a pitch $p_1$, this layer C1 itself being surrounded by an outer layer (C2) of P wires of diameter $d_2$ wound together in a helix at a pitch $p_2$, P being less by 1 to 3 than the maximum number $P_{max}$ of wires which can be wound in one layer about the layer C1, this cable being characterised in that it has the following characteristics ($d_0$, $d_1$, $d_2$, $p_1$ and $p_2$ in mm):

(i) $0.10 \leqq d_0 < 0.50$;

(ii) $0.25 \leqq d_1 < 0.40$;

(iii) $0.25 \leqq d_2 < 0.40$;

(iv) for N=4: $0.40 < (d_0/d_1) < 0.80$;
for N=5: $0.70 < (d_0/d_1) < 1.10$;

(v) $4.8\ \pi(d_0+d_1) < p_1 < p_2 < 5.6\ \pi(d_0+2d_1+d_2)$; and (vi) the wires of layers C1 and C2 are wound in the same direction of twist.

2. The cable according to claim 1, of construction [1+N+P], wherein the core is formed by a single wire.

3. The cable according to claim 2, selected from the group consisting of constructions [1+4+8], [1+4+9], [1+4+10], [1+5+9], [1+5+10] and [1+5+11].

4. The cable according to claim 1, of construction [1+5+P].

5. The cable according to claim 4, of construction [1+5+10].

6. The cable according to claim 4, of construction [1+5+11].

7. The cable according to claim 1, which satisfies the following relationship:

$0.25 \leqq d_1 \leqq 0.35$;

$0.25 \leqq d_2 \leqq 0.35$.

8. The cable according to claim 1, which satisfies the following relationship:

$0.15 \leqq d_0 \leqq 0.30$.

9. The cable according to claim 8, characterised in that the steel is a carbon steel.

10. The cable according to claim 1, characterised in that it is a steel cable.

11. The cable according to claim 1, which satisfies the relationship:

$5.0\ \pi(d_0+d_1) < p_1 < p_2 < 5.0\ \pi(d_0+2d_1+d_2)$.

12. The cable according to claim 11, which satisfies the relationship:

$5.3\ \pi(d_0+d_1) < p_1 < p_2 < 4.7\ \pi(d_0+2d_1+d_2)$.

13. The cable according to claim 1, wherein the ratio ($d_1/d_2$) is between 1.05 and 1.30.

14. The cable according to claim 13, wherein the ratio ($d_1/d_2$) is between 1.05 and 1.15.

15. The cable according to claim 1, wherein said core comprises M wires, wherein M is equal to or greater than 2.

16. A composite fabric usable as a crown reinforcement ply for a radial tire, comprising a matrix of rubber composition reinforced by a multi-layer cable having a unsaturated outer layer, comprising a core (C0) of diameter $d_0$ surrounded by an intermediate layer (C1) of four or five wires (N=4 or 5) of diameter $d_1$ wound together in a helix at a pitch $p_1$, this layer C1 itself being surrounded by an outer layer (C2) of P wires of diameter $d_2$ wound together in a helix at a pitch $p_2$, P being less by 1 to 3 than the maximum number $P_{max}$ of wires which can be wound in one layer about the layer C1, this cable having the following characteristics ($d_0$, $d_1$, $d_2$, $p_1$ and $p_2$ in mm):

(i) $0.10 \leqq d_0 < 0.50$;

(ii) $0.25 \leqq d_1 < 0.40$;

(iii) $0.25 \leqq d_2 < 0.40$;

(iv) for N=4: $0.40 < (d_0/d_1) < 0.80$;
for N=5: $0.70 < (d_0/d_1) < 1.10$;

(v) $4.8\ \pi(d_0+d_1) < p_1 < p_2 < 5.6\ (d_0+2d_1+d_2)$; and (vi) the wires of layers C1 and C2 are wound in the same direction of twist.

17. The fabric according to claim 16, wherein the multi-layer cable, of construction [1+N+P], has a core formed by a single wire.

18. The fabric according to claim 17, wherein the multi-layer cable is selected from among the group consisting of cables of the constructions [1+4+8], [1+4+9], [1+4+10], [1+5+9], [1+5+10] and [1+5+11].

19. The fabric according to claim 17, wherein the multi-layer cable has a construction [1+5+P].

20. The fabric according to claim 19, wherein the multi-layer cable has a construction [1+5+10].

21. The fabric according to claim 19, wherein the multi-layer cable has a construction [1+5+11].

22. The fabric according to claim 16, wherein the following relationships are satisfied:

$0.25 \leqq d_1 \leqq 0.35$;

$0.25 \leqq d_2 \leqq 0.35$.

23. The fabric according to claim 16, wherein the following relationship is satisfied:

$0.15 \leqq d_0 \leqq 0.30$.

24. The fabric according to claim 16, wherein the multi-layer cable is a steel cable.

25. The fabric according to claim 24, wherein the steel is a carbon steel.

26. The fabric according to claim 16, wherein the following relationship is satisfied:

$5.0\ \pi(d_0+d_1) < p_1 < p_2 < 5.0\ \pi(d_0+2d_1+d_2)$.

27. The fabric according to claim 16, wherein the following relationship is satisfied $5.3\ \pi(d_0+d_1) < p_1 < p_2 < 4.7\ \pi(d_0+2d_1+d_2)$.

28. The fabric according to claim 16, wherein the ratio $(d_1/d_2)$ is between 1.05 and 1.30.

29. The fabric according to claim 28, wherein the ratio $(d_1/d_2)$ is between 1.05 and 1.15.

30. The fabric according to claim 16, wherein the cable density is between 20 and 70 cables per dm of fabric.

31. The fabric according to claim 30, wherein the cable density is between 30 and 60 cables per dm of fabric.

32. The fabric according to claim 16, wherein the width l of the bridge of rubber composition, between two adjacent cables, is between 0.5 and 2.0 mm.

33. The fabric according to claim 32, wherein the width l is between 0.8 and 1.6 mm.

34. The fabric according to claim 16, wherein the rubber composition has, in the vulcanized state, a secant tensile modulus MA10 which is greater than 5 MPa.

35. The fabric according to claim 34, wherein the rubber composition has, in the vulcanized state, a modulus MA10 which is between 5 and 20 MPa.

36. The fabric according to claim 16, wherein the rubber is natural rubber.

37. A tire having a crown reinforcement which comprises a multi-layer cable having a unsaturated outer layer, comprising a core (C0) of diameter $d_0$ surrounded by an intermediate layer (C1) of four or five wires (N=4 or 5) of diameter $d_1$ wound together in a helix at a pitch $p_1$, this layer C1 itself being surrounded by an outer layer (C2) of P wires of diameter $d_2$ wound together in a helix at a pitch $p_2$, P being less by 1 to 3 than the maximum number $P_{max}$ of wires which can be wound in one layer about the layer C1, this cable having the following characteristics ($d_0$, $d_1$, $d_2$, $p_1$ and $p_2$ in mm):

(i) $0.10 \leqq d_0 < 0.50$;

(ii) $0.25 \leqq d_1 < 0.40$;

(iii) $0.25 \leqq d_2 < 0.40$;

(iv) for N=4: $0.40 < (d_0/d_1) < 0.80$;
for N=5: $0.70 < (d_0/d_1) < 1.10$;

(v) $4.8\ \pi(d_0+d_1) < p_1 < p_2 < 5.6\ \pi(d_0+2d_1+d_2)$; and (vi) the wires of layers C1 and C2 are wound in the same direction of twist.

38. The tire according to claim 37, wherein the multi-layer cable, of construction [1+N+P], has a core formed by a single wire.

39. The tire according to claim 38, wherein the multi-layer cable is selected from among the group consisting of cables of the constructions [1+4+8], [1+4+9], [1+4+10], [1+5+9], [1+5+10] and [1+5+11].

40. The tire according to claim 37, wherein the multi-layer cable has a construction [1+5+P].

41. The tire according to claim 40, wherein the multi-layer cable has a construction [1+5+10].

42. The tire according to claim 40, wherein the multi-layer cable has a construction [1+5+11].

43. The tire according to claim 37, wherein the following relationships are satisfied:

$0.25 \leqq d_1 \leqq 0.35$;

$0.25 \leqq d_2 \leqq 0.35$.

44. The tire according to claim 37, wherein the following relationship is satisfied:

$0.15 \leqq d_0 \leqq 0.30$.

45. The tire according to claim 37, wherein the multi-layer cable is a steel cable.

46. The tire according to claim 45, wherein the steel is a carbon steel.

47. The tire according to claim 37, wherein the following relationship is satisfied:

$5.0\ \pi(d_0+d_1) < p_1 < p_2 < 5.0\ \pi(d_0+2d_1+d_2)$.

48. The tire according to claim 47, wherein the following relationship is satisfied $5.3\ \pi(d_0+d_1) < p_1 < p_2 < 4.7\ \pi(d_0+2d_1+d_2)$.

49. The tire according to claim 37, wherein the ratio $(d_1/d_2)$ is between 1.05 and 1.30.

50. The tire according to claim 49, wherein the ratio $(d_1/d_2)$ is between 1.05 and 1.15.

* * * * *